United States Patent [19]

Taylor

[11] Patent Number: 4,778,027

[45] Date of Patent: Oct. 18, 1988

[54] RHYTHMIZER

[76] Inventor: Mildred E. Taylor, 1900 S.W. 84 Avenue, Miami, Fla. 33155

[21] Appl. No.: 49,651

[22] Filed: Apr. 30, 1987

[51] Int. Cl.[4] ..... G10K 11/00

[52] U.S. Cl. ..... 181/175; 181/141; 181/144; 181/150; 181/199; 381/63; 381/152; 381/205

[58] Field of Search ..... 181/30, 143, 144, 150, 181/161, 163, 175, 199, 141; 381/188, 63–65, 152, 205, 77; 52/403, 480, 481, 508, 512, 828

[56] References Cited

U.S. PATENT DOCUMENTS

| | | | |
|---|---|---|---|
| 1,693,655 | 12/1928 | Murphy | 52/480 X |
| 1,962,055 | 6/1934 | Cawley | 381/77 |
| 2,520,172 | 8/1950 | Rubinstein | 181/141 X |
| 2,862,255 | 12/1958 | Nelson | 52/403 |
| 3,311,712 | 3/1967 | Cain | 381/152 |
| 3,604,173 | 9/1971 | Ripsavagen | 52/508 |
| 4,064,376 | 12/1977 | Yamada | 381/152 |
| 4,098,370 | 7/1978 | McGregor et al. | 181/150 |
| 4,507,816 | 4/1985 | Smith, Jr. | 381/152 X |

*Primary Examiner*—B. R. Fuller

*Attorney, Agent, or Firm*—John Cyril Malloy

[57] ABSTRACT

A reverberating platform structure usable as an exercise floor or, depending upon the configuration thereof, for the support of people or objects thereon wherein the platform is supported by an anchor structure above a foundation such that there is an open space between the foundation and the undersurface of the platform. The anchor structure may be essentially flexible so as to provide a giving or flexible structure to the platform for a person to exercise, dance, or otherwise move thereon. An agitator assembly primarily in the form of a plurality of speakers are disposed within the space immediately adjacent to the space slightly from the undersurface of the supporting platform wherein activation of the speakers causes vibration to be communicated directly to the platform but wherein the platform is further structured not to generate specific sounds therefrom so as to be considered part of the speaker system itself. The vibrations communication to the platform causes a reverberation thereof which is harmonious with any changes in the audible rhythmic changes of the vibrations emanating from the speakers.

11 Claims, 2 Drawing Sheets

RHYTHMIZER

BACKGROUND OF THE INVENTION

1. Field of the Invention

A supporting platform for an object, preferably a person, on which the person may dance or otherwise exercise and in different embodiments being configured to allow a reclining or sitting orientation of the person thereon. The platform is directly exposed to varying degrees of pulsation or vibration caused by an assembly of speakers disposed beneath the undersurface of the supporting platform in spaced but "communicating" relation thereto so as to affect the vibration in the platform upon an activation of the speaker assembly wherein the vibration may effectively be "felt" by the objects and/or people touching or supported on the platform.

2. Description of the Prior Art

Man's response to music in the form of dancing, exercise, etc. is well known and common regardless of age, background, heritage, etc. Any enhancement of the enjoyment of music or sound in general would be equally well accepted as a basic concept of dancing to the rhythm of the music itself. Accordingly, it is believed that there is a need for a reverberation assembly of the type which incorporates a platform used for the support of objects and primarily people thereon. The platform could be of simple design capable of allowing movement, such as when dancing or exercising, of a plurality of people on an exposed surface thereof. Alternately, the platform could take a variety of other configurations which allow a person to at least partially recline or be repositioned in a somewhat sitting orientation thereon. In any of the aforementioned embodiments, cooperation of the platform with a speaker assembly such that the person could in effect could "feel" vibration of the platform caused by activation of the speaker assembly wherein the generation of sound and preferably music would cause rhythmic vibration in accordance with the sound or music to be effectively communicated, through physical touch to the person or object on the exposed surface of the platform.

Numerous devices in the prior art, some of which have been in existence for many years are evidenced by certain existing United States patents. Specifically, the following United States patents all relate generally to the subject matter of the type described herein: U.S. Pat. Nos. Murphy, 1,693,655; Cawley, 1,962,055; Nelson, 2,862,255; Cain, 3,311,712; Dahlborg, 3,604,173; and Kuebler, 3,668,885.

Nelson discloses a floor construction which is directed specifically to the cushioning of a wood floor so as to maintain a certain amount of resiliency during the use of the floor for the expressed purpose of preventing or at least delaying tiredness or aches resulting from dancing, skating, or like activities. The patents to Cain and Cawley as cited above, are directed to the production or reproduction of sound by effectively making a solid object such as a floor, wall, ceiling, etc. a vibrating diaphragm component of the speaker itself. These patents are both directed to sound reproduction per se and not the specific generation or production of rhythmic vibration for the purpose of allowing people to both "feel" the sound as well as hearing the sound. In addition, Cain relates to a sonic transducer which incorporates a solid object as a vibrating diaphragm component through its direct physical contact with a transducer mechanism.

Accordingly, prior art attempts to enhance the enjoyment of sound or music per se have not resulted or been extended to the point where vibrations are specifically and purposely set up without the generation of sound or making a supporting platform a portion of the speaker system itself to the extent that people or objects on the exposed surface of the platform can effectively "feel" the vibration set up in the platform upon the activation of the speaker and the generation therefrom of sound, particularly music.

SUMMARY OF THE INVENTION

The subject invention is an assembly specifically designed to set up vibrations in a platform or like supporting or available surface capable of being touched by a person as by standing thereon or alternately by any number of people. Alternately and as will be explained in greater detail hereinafter, the support platform may take a variety of configurations which allow for the partial inclination of people thereon or orientation of the people in a somewhat sitting orientation such as when the "platform" is in the form of a chair, a church pew, bench, reclining chair, etc.

Regardless of the embodiment, the vibrations set up are in synchronization or occur in rhythm with the music or like sounds produced and generated from a speaker assembly located beneath the supporting platform but in direct cooperation and communication therewith. The speaker assembly may include at least one but more probably a plurality of such speakers, depending upon the size of the platform to be used. It is to be emphasized that the platform itself does not serve as a diaphragm component of the speaker and does not reproduce or generate sound therefrom. The thickness of the platform, the configuration of its undersurface, and its overall dimension is determined in cooperative relation to the size, quality, etc. of the speaker assembly and the relative disposition therebetween such that upon emanation of sound from the speaker assembly, the platform means will be caused to vibrate for the purpose of allowing such vibration, in a rhythmic fashion, to be "felt" by the objects or people supported on the exposed surface of the platform.

In a more specific application, the sound is generated from the speaker assembly and directed towards or onto a lower or undersurface of the platform. Vibration is set up or occurs within the platform and such "rhythmic vibration" is transferred to people touching the platform means or standing thereon. These people may therefore not only hear the sound generated from the speaker assembly but may in fact "feel" the sound through communication with the "rhythmic vibrations" generated from the platform means.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts through the several views of the drawings.

DETAILED DESCRIPTION OF THE PREFERRED EMBODIMENT

Figure 1:
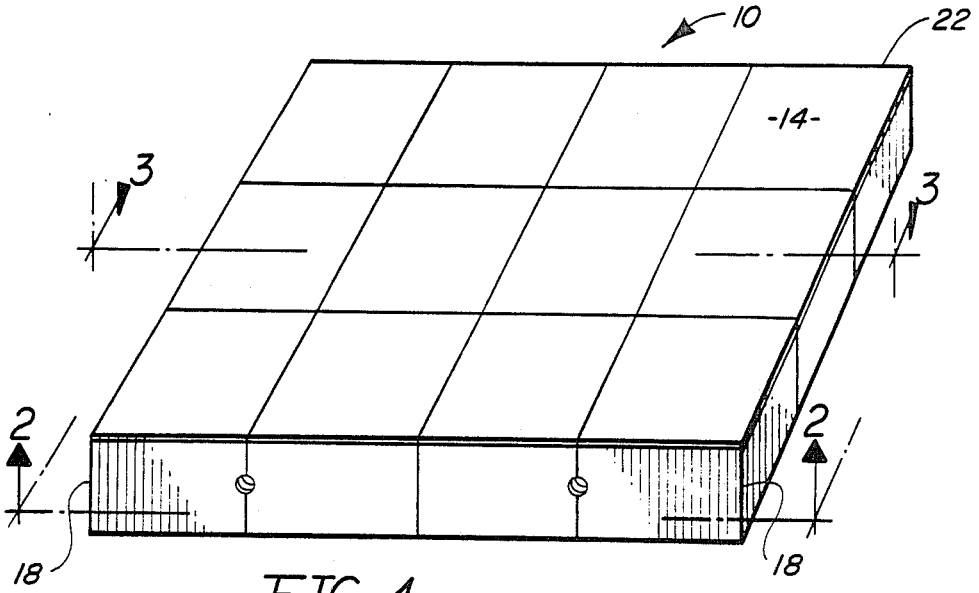
FIG. 1 is a perspective view of one embodiment of the support platform preferably in the form of a dance or exercise floor.
Figure 2:
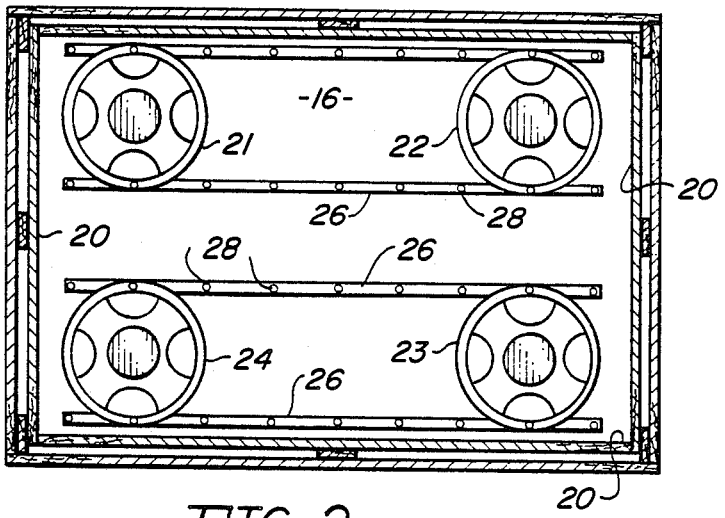
FIG. 2 is a sectional view along line 2—2 showing interior structural details of the support platform of FIG. 1 and showing the location of a speaker assembly on the interior thereof.
Figure 3:
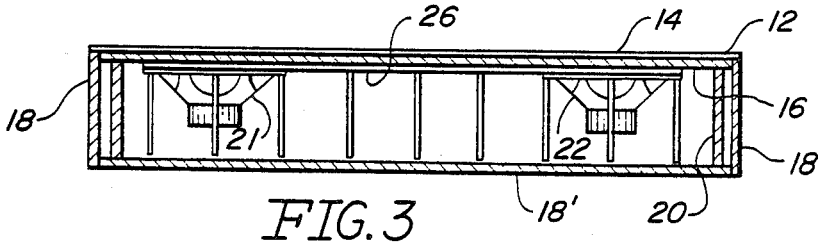
FIG. 3 is a sectional view along line 3—3 of FIG. 1.

As shown in FIGS. 1 through 3, the assembly generally indicated as 10 is directed towards a support platform of the configuration and dimension to support a plurality of objects, preferably people, on an exposed surface thereof as at 14 for the purpose of exercise, dance, etc. As shown, the support platform 12 has a hollow interior having an undersurface 16 of the support platform 12 and depending supporting skirt or front foundation as at 18 disposed in surrounding relation to the platform 12 and supporting it thereon on any type of applicable supporting surface.

An anchor means is provided as at 20 serving to secure and define interior portions of the hollow interior of the assembly 10 in specific configurations so as to allow mounting therein of a speaker means. The speaker means comprises at least one but preferably a plurality of speakers 21 through 24 fixedly secured to mounting or anchor strips 26 disposed in spaced apart relation to one another and secured to the undersurface 16 of a support platform 12 by conventional connector elements 28 in a manner which will provide at least a minimal space between the undersurface 16 and the exposed face of the speakers 21 through 24. This space is sufficient to allow direct communication and "transmission" of any sound waves issuing from the respective speakers directly onto the undersurface 16 for the "creation" of vibration directly in the support platform 12. Such vibration is, due to the thickness of the support platform 12 directly transferrable to the exposed surface 14 any objects or people supported or moving thereon. The exposed surface 14 therefore, upon being "touched", serves as a direct transmitter to the objects or people thereon of the proper "feel" of the sound or music emanating from the speakers 21 through 24. It should be specifically noted that the configuration and disposition of the speakers 21 through 24 relativeto the undersurface 16 of the support platform 12 and the exposed surface portion thereof 14 is such as to not make the support platform in fact a vibrating diaphragm part of the speakers themselves but rather, merely transmit the feel of the rhythmic vibration created upon activation of the speakers 21 through 24 and the emanation of sound therefrom preferably in the form of music.

Figure 4:
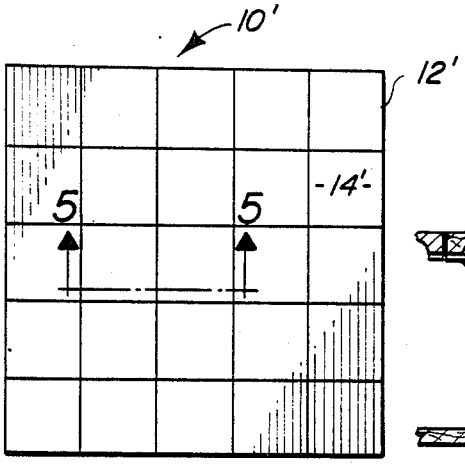
FIG. 4 is another embodiment of the present invention wherein the support platform comprises a plurality of platform segments secured in adjacent relation to one another.
Figure 5:
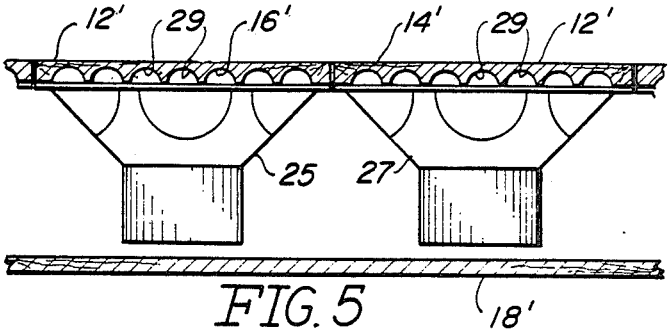
FIG. 5 is a sectional view in partial cutaway along line 5—5 of FIG. 4 showing a relation of the speaker assembly to the platform segments comprising the platform of the embodiment of FIG. 4.

With regard to FIGS. 4 and 5, one embodiment of the present assembly 10′ shows the support platform 12′ including the exposed surface 14′ being made from a plurality of platform segments disposed in immediately adjacent and connected relation to one another as best shown in FIG. 5. The individual platform segments 12′ disposed in their connected and collective array as pictured in both FIGS. 4 and 5 thereby form the exposed outer surface 14′. In the embodiment shown in FIGS. 4 and 5. The speaker assembly comprises a plurality of speakers 25 and 27 specifically wherein each of the speakers are disposed and dimensioned to depend beneath and cooperate with a single one of the individual platform segments as at 12′ and be disposed in facing relation to the undersurface thereof as at 16′.

Further in the embodiment shown in FIG. 5, the undersurface 16′ comprises a plurality of integrally formed indentations extending over all or at least a majority of the surface area of the undersurface 16′. Such indentations 29 may be in the form of a plurality of apertures or elongated grooves as shown in sectional view of FIG. 5.

The proper "facing" description of the speakers indicates as is shown in FIG. 5 that the exposed face of the vibrating diaphragm conventional to most speaker constructions is disposed in immediately adjacent but clearly spaced apart relation to the undersurface 16 (FIGS. 1 through 3) or 16′ (FIGS. 4 and 5).

Figure 6:
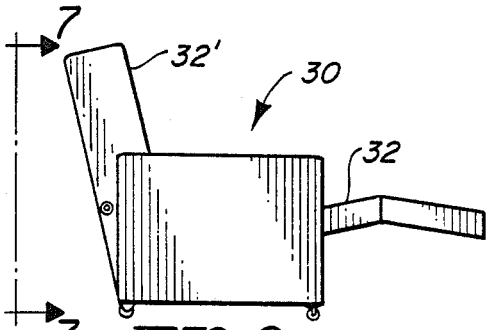
FIG. 6 shows another embodiment of the support platform preferably in the form of a reclining chair or like structure capable of supporting a person or object in a reclining orientation.
Figure 7:
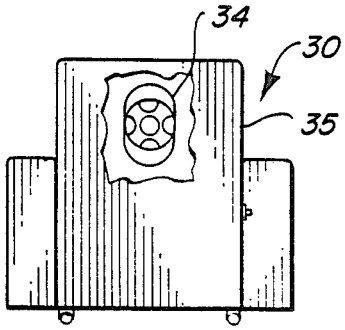
FIG. 7 is a rear view along line 7—7 of FIG. 6 in partial cutaway showing the location of a speaker assembly in the embodiment of FIGS. 6 and 7.

Another embodiment of the present invention is represented in FIGS. 6 and 7 generally indicated as 30 wherein the support platform 32 is in the form of a reclining chair on which a person may be at least partially reclined or oriented in a sitting position. In such an embodiment, the speaker assembly 34 is located on the interior of at least a portion 35 of the support platform 32 to the extent that it is still disposed so as to allow a "feel" of the vibrations caused in the platform 32 and 32′ by any person or object disposed on the surface 32 or 32′.

Figure 8:
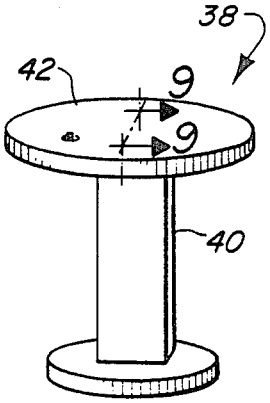
FIG. 8 is a perspective view of the support platform in the form of a horizontal supporting table surface.
Figure 9:
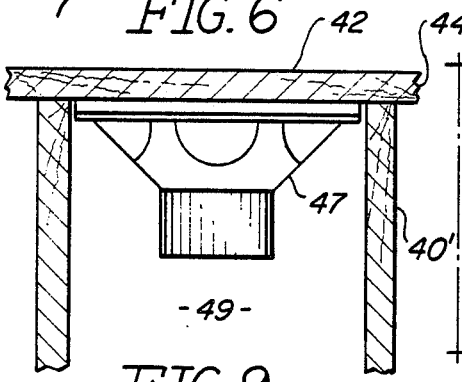
FIG. 9 is a sectional view in partial cutaway along line 9—9 of FIG. 8.

With regard to FIGS. 8 and 9, yet another embodiment of the present invention is generally indicated as 38 in the form of a table 40 having an upper horizontally exposed supporting table surface 42 serving as the support platform such that the exposed supporting surface 42 will be caused to vibrate as well as the "table top" 44 upon activation of the speaker 47 in the manner disclosed previously. The speaker 47 is mounted on the hollow interior 49 of the pedestal 40' as shown in FIG. 9.

Figure 10:
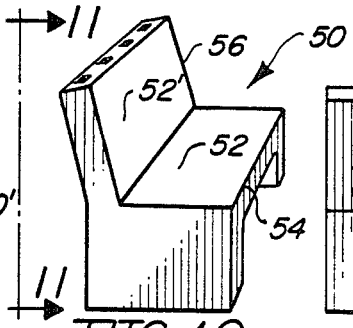
FIG. 10 is yet another embodiment of the support platform being in the form of an elongated sitting bench or pew.
Figure 11:
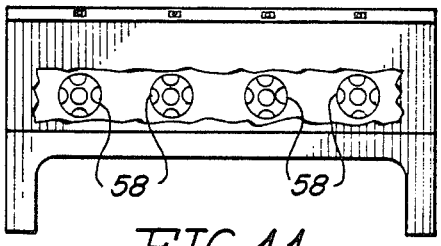
FIG. 11 is a rear view along line 11—11 of FIG. 10 in partial cutaway showing locations of a speaker assembly relative to the structural embodiment of the platform of FIG. 10.

Yet another embodiment of the present invention as shown in FIG. 10 is generally represented as 50 in the form of an elongated sitting bench or pew having the exposed surface 52 of the support platform 54 specifically configured to allow people to be supported thereon in a sitting orientation. As shown in FIG. 11, the speaker assembly of the present invention is mounted on the backrest portion 56 but in cooperative relation to the exposed surface 52 so as to allow the "feel" of the vibrations created by the emanation of sounds from the plurality of speakers 58 as shown in FIG. 11.

Figure 12:
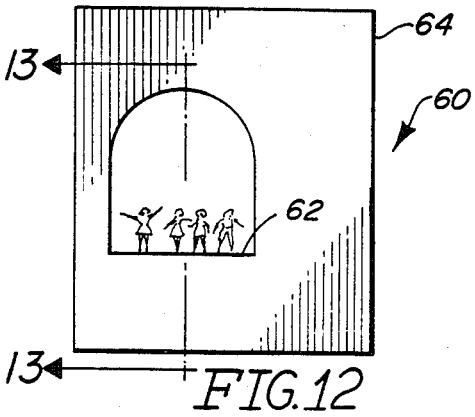
FIG. 12 is a front plan view of yet another embodiment of the present invention incorporating objects rather than people on a supporting platform generally for the entertainment of one viewing from an exterior thereof.
Figure 13:
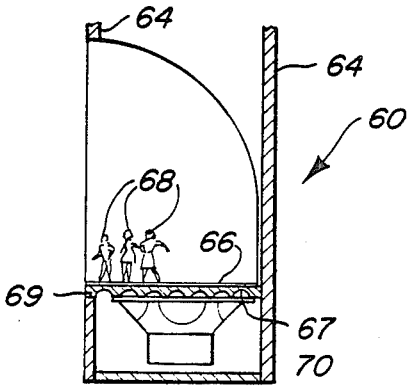
FIG. 13 is a sectional view in partial cutaway along line 13—13 of FIG. 12.

Yet another feature of the present invention is shown in FIG. 12 wherein an entertainment stage assembly may be represented generally as 60 including a stage area 62 and a housing 64 disposed in surrounding relation thereto. The support platform 66 is sufficient in size to allow objects 68 such as miniatures to be disposed thereon and "feel" the vibration through the support platform 69. The aforementioned vibration occurs in the manner described with the embodiments set forth above by the activation of the speaker assembly 70 and the emanation of sound and vibration through the platform 69 as the sound is generated from the speaker 70, upon its activation, directly onto the undersurface 67 as clearly shown in FIG. 13.

Now that the invention has been described,

What is claimed is:

1. A reverberation support assembly to support an object thereon, said assembly comprising:

(a) platform means including an upper exposed surface dimensioned and configured to support an object, while in motion, thereon, (b) said support platform means further including an undersurface disposed in substantially spaced relation from said upper surface by a thickness of said platform means and extending over a substantially equally dimensioned area as said upper surface, (c) anchor means disposed in substantially supporting relation to said platform means and engaging relation to said undersurface and further disposed in supported relation to a foundation, (d) said anchor means disposed and dimensioned to define a space between said undersurface of said platform means and said foundation, said space extending across a major portion of said undersurface, (e) speaker means mounted within said space and disposed to include a face portion thereof, said speaker means including said face portion being positioned independent of said platform means and in spaced, non-connected and immediate adjacent relation to said undersurface, said speaker means structured to produce sound and generate sound from said face portion towards an undersurface of said platform means, (f) said platform means being of a predetermined thickness and structure relative to the capacity of said speaker means and sound generation therefrom to have vibration occurring therein and further being structured to communicate said vibration to said upper surface, (g) said platform means being further cooperatively structured with the structure of said speaker means and disposed relative thereto to be void of any sound reproduction due to said occurring vibration therein and specifically communicative of said occurring vibration to objects touching said upper surface.

2. An assembly as in claim 1 wherein said speaker means comprises a plurality of speaker elements disposed within said space and each having a face portion disposed in immediately adjacent and spaced relation to said undersurface.

3. An assembly as in claim 2 wherein said plurality of speaker elements are disposed in a predetermined array to cover a major portion of said undersurface.

4. An assembly as in claim 3 wherein said anchor means is disposed in supporting relation to said platform means substantially about a periphery of said undersurface thereof and comprises a flexible structure.

5. An assembly as in claim 1 wherein said foundation is fixedly disposed relative to said platform means.

6. An assembly as in claim 1 wherein said platform means is dimensioned and structured to movably support a person on said upper exposed surface thereof and transmit vibration occurring therein to the person.

7. An assembly as in claim 1 wherein said undersurface comprises a plurality of indentations formed therein and extending over a major portion of the exposed area of said undersurface.

8. An assembly as in claim 6 wherein said face of said speaker means is spaced from but in directly communicating relation with said plurality of indentations on said upper surface.

9. An assembly as in claim 8 wherein said speaker means comprises a plurality of speakers and said platform means comprises a plurality of platform segments disposed in immediately adjacent and interconnected relation to one another, each of said speakers disposed and dimensioned to be secured immediately beneath and in depending relation from one only platform segment and in facing relation to an undersurface portion thereof.

10. An assembly as in claim 1 wherein said platform means is configured to spport a person thereon in an at least partially sitting orientation.

11. An assembly as in claim 1 wherein said platform means comprises a substantially horizontally oriented supporting table surface.

* * * * *